US005487486A

United States Patent [19]

Meneo

[11] Patent Number: 5,487,486

[45] Date of Patent: Jan. 30, 1996

[54] BEVERAGE CONTAINER WITH ICE COMPARTMENT FILLED BY INVERTED SCOOPING

[76] Inventor: David M. Meneo, 241 Karen Dr., Orange, Conn. 06477-2935

[21] Appl. No.: 374,850

[22] Filed: Jan. 19, 1995

Related U.S. Application Data

[63] Continuation of Ser. No. 114,436, Aug. 30, 1993, abandoned, which is a continuation-in-part of Ser. No. 920,018, Jul. 27, 1992, abandoned.

[51] Int. Cl.[6] ..... B65D 25/04

[52] U.S. Cl. ..... 220/504; 220/505; 220/506; 220/608; 215/6; 215/398

[58] Field of Search ..... 215/6, 10, 396, 215/398; 62/457.3, 457.4, 529; 222/130, 146.6, 465.1; 220/506, 505, 504, 608, 609, 669, 427, 428, 23.83, 23.86, 503

[56] References Cited

U.S. PATENT DOCUMENTS

| | | | |
|---|---|---|---|
| 544,219 | 8/1895 | Godet . | |
| 879,516 | 2/1908 | Cantwell . | |
| 1,519,034 | 12/1924 | Livingston . | |
| 1,572,242 | 2/1926 | McLaughlin . | |
| 1,657,927 | 1/1928 | Heinzen . | |
| 1,835,463 | 12/1931 | Campbell . | |
| 1,942,248 | 1/1934 | Kemp | 91/67.1 |
| 1,960,747 | 5/1934 | Marks | 220/94 |
| 2,075,137 | 3/1937 | Rosen | 62/91.5 |
| 2,187,558 | 1/1940 | Kushima | 62/142 |
| 2,460,765 | 2/1949 | Palaith | 62/92 |
| 3,282,068 | 11/1966 | Cain | 62/57 |
| 3,302,427 | 2/1967 | Stoner et al. | 62/457 |
| 4,402,195 | 9/1983 | Campbell | 62/457 |
| 4,410,085 | 10/1983 | Beneziat et al. | 206/217 |
| 4,584,848 | 4/1986 | Barnett | 62/294 |
| 4,874,107 | 10/1989 | Arnau-Munoz et al. | 220/20 |
| 4,981,022 | 1/1991 | Snyder | 62/457.3 |
| 4,986,089 | 1/1991 | Raab | 62/457.4 |
| 5,189,892 | 3/1993 | Roberts | 62/372 |

FOREIGN PATENT DOCUMENTS

| | | |
|---|---|---|
| 367398 | 10/1906 | France . |
| 256156 | 8/1926 | United Kingdom . |

*Primary Examiner*—Stephen J. Castellano
*Attorney, Agent, or Firm*—DeLio & Peterson

[57] ABSTRACT

A beverage container including a beverage compartment, an ice compartment in heat exchange contact with the beverage compartment, a handle and a cap. The beverage compartment opens upward. The ice compartment opens downward and is quickly filled by holding the container inverted and scooping the opening into crushed ice. The handle is specially configured for both upright and inverted use. It is placed in a balanced location relative to the midpoint of the container and designed with sufficient thickness that it can be gripped tightly with comfort as needed when scooping ice. The cap makes a watertight seal to close the ice compartment and form a base for the container when it is upright. The container is formed of an impact resistant material to resist repeated scooping impacts with ice and preferably forms the two compartments as an integral one-piece compartment. The ice compartment is arranged to provide greater cooling per unit volume of beverage when the container is partially full than when completely full, and ribs or other protrusions increase the heat transfer rate between the ice and beverage compartments.

23 Claims, 9 Drawing Sheets

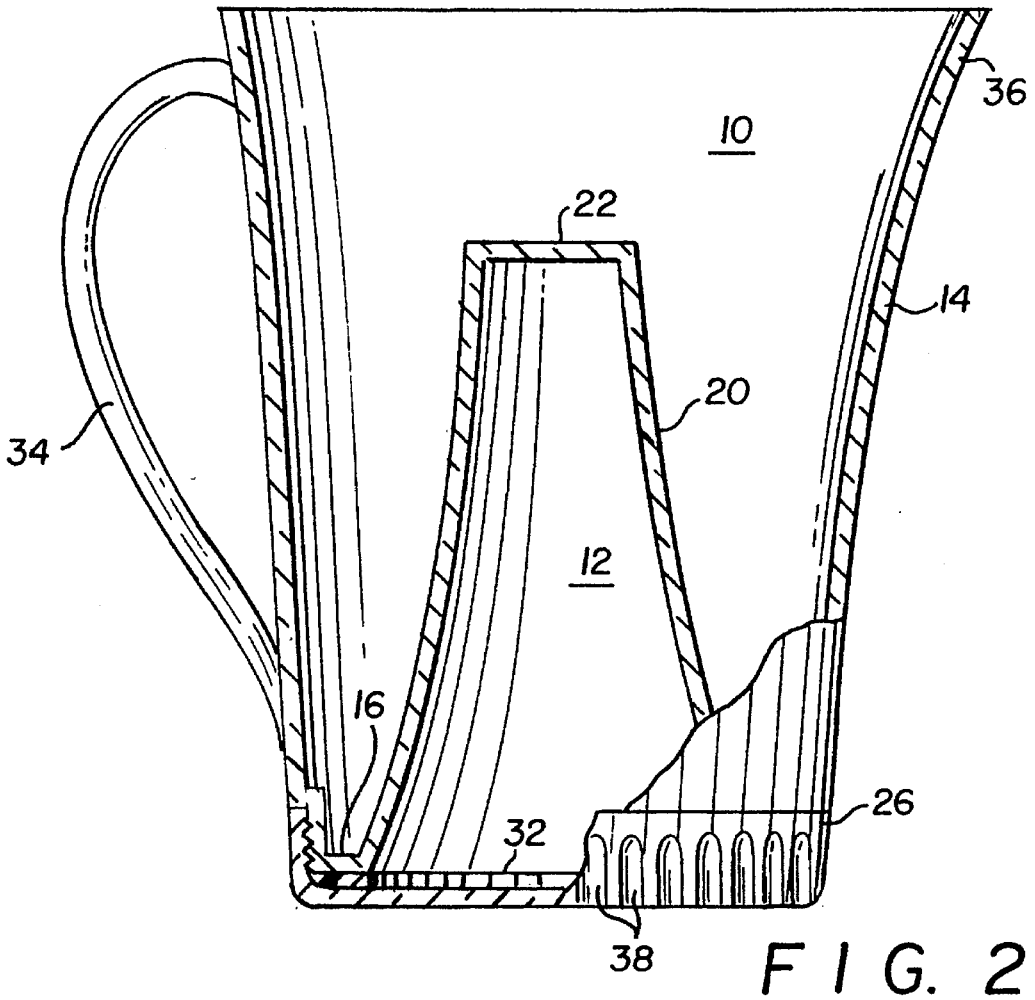
FIG. 2
FIG. 3
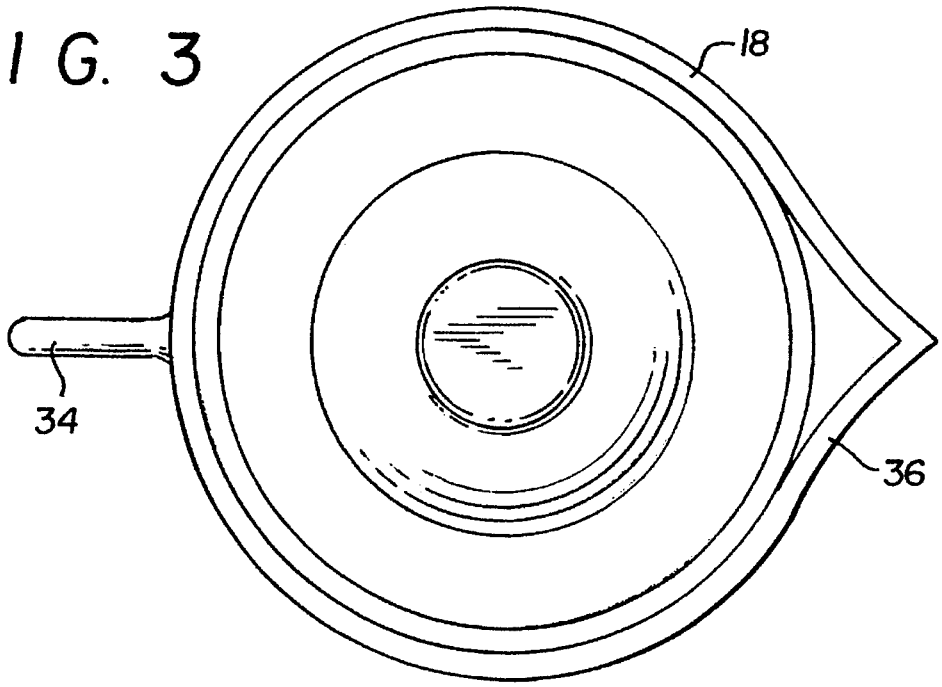

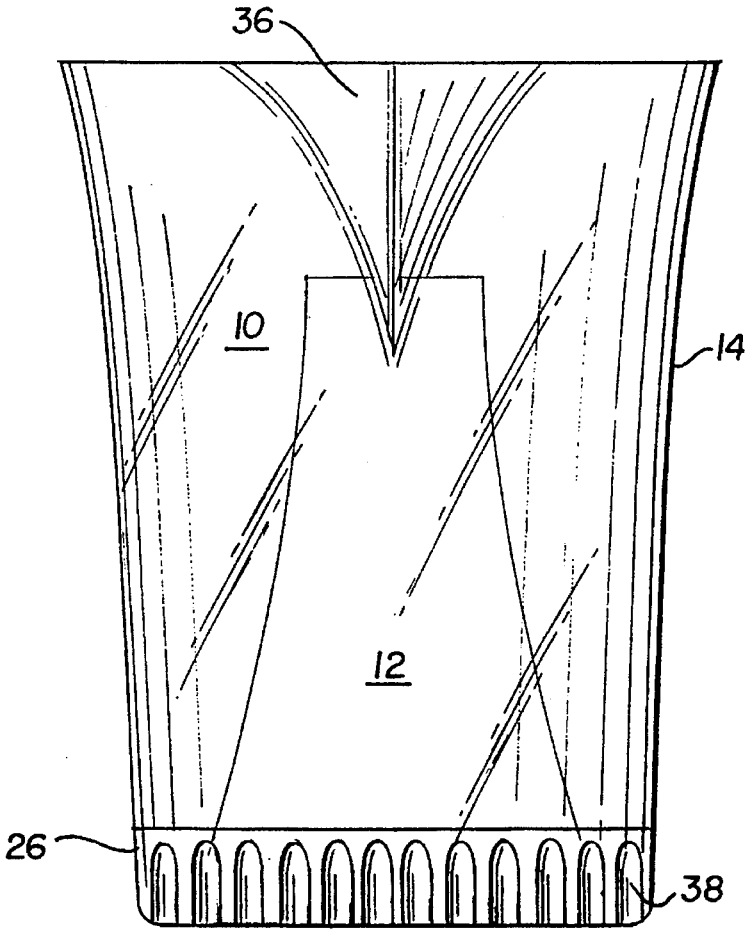
FIG. 4
FIG. 5
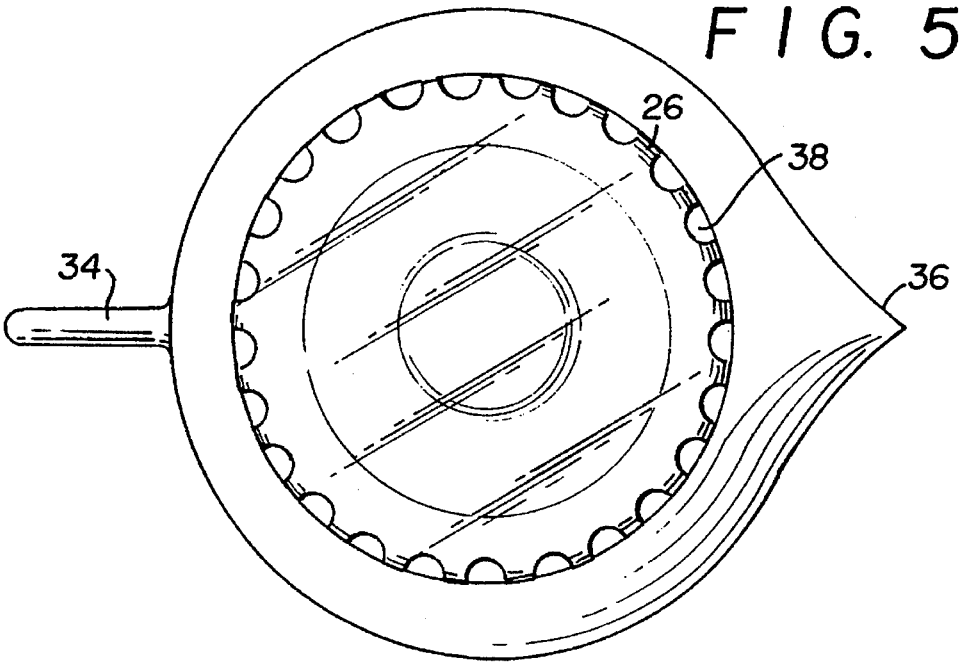

BEVERAGE CONTAINER WITH ICE COMPARTMENT FILLED BY INVERTED SCOOPING

CROSS REFERENCE TO RELATED APPLICATION

This is a continuation of application Ser. No. 114,436, filed on Aug. 30, 1993, abandoned, which is a continuation-in-part application of U.S. patent application Ser. No. 07/920,018 filed Jul. 27, 1992 abandoned.

BACKGROUND OF THE INVENTION

1. Field of the Invention

This invention relates to beverage containers which have separate ice and beverage compartments. In such containers, the ice compartment is in heat exchange contact with the beverage compartment to keep the beverage cold while it is being consumed, without diluting the beverage as the ice melts.

2. Description of Related Art

Many beverages are best when served cold, including beer, soda and iced tea among others. Ice is the preferred way to keep the beverage cold as it is consumed, and for some beverages, such as soda and iced tea, it is common to place the ice directly into the beverage container where it dilutes the beverage as it melts. For other beverages, such as beer, this dilution is unacceptable.

For such beverages, even where the beverage and the beverage container are chilled prior to serving, the beverage rapidly becomes unacceptably warm even in an insulated container. The problem is compounded by the fact that many chilled beverages are consumed during the warmest months of year.

To eliminate the problem of dilution, various methods of cooling the beverage have been tried. One method has been to use a plastic-coated freezable gel material either as an artificial ice cube floating in the beverage, or as a strap-on coolant pack outside, but in contact with the beverage compartment. Both methods are expensive, and require additional freezer equipment and/or space for the numerous gel-cubes or gel-packs to be used. The artificial ice cube method has the added difficulties of risk of contamination from the gel material and sterilization costs in reusing the cubes.

Another method has been to use standard ice to cool the beverage, but to isolate the ice from the beverage in a separate compartment, thereby excluding the meltwater from the beverage compartment. This method has proven somewhat more satisfactory due to the existing investment and wide availability of ice-makers found in most homes and food service businesses.

Nonetheless, previous beverage containers employing the separate compartment design suffer from several deficiencies which have prevented their wide acceptance. One difficulty has been that most such containers fill both the ice compartment and the beverage compartment from the top. In this arrangement, the opening for the ice must compete for space with the opening for the beverage. The opening to the ice compartment is invariably too small making it difficult to fill with ice quickly. Enlarging the opening of the ice compartment makes it easier to fill with ice, but more difficult to fill with beverage.

A related difficulty has been that it is too easy to inadvertently get ice in the beverage compartment or beverage in the ice compartment when filling the separate compartments. The difficulty of filling the ice compartment in prior designs is less objectionable in low volume applications, but in commercial establishments the time involved to carefully fill the ice compartment of each beverage container cannot be justified.

Even those beverage containers which may be filled from the bottom, thereby eliminating the possibility of mixing beverage and ice, have not been satisfactory in commercial establishments. In some cases the beverage container is too fragile, too thin or is made of a material not suitable for scooping into the ice (such as glass, porcelain or other material which may chip). In other cases, the container has no handle, has a handle that is too thin and cannot be gripped tightly, or has a handle not positioned properly on the container. These problems prevent the container from being comfortably used in the inverted position to quickly scoop crushed ice or ice cubes into the ice compartment. Each of these deficiencies leads to a decrease in the speed with which the container can be filled.

Yet another problem has been that prior art designs do not cool the beverage efficiently. In normal use, the beverage container is initially filled with a pre-cooled beverage. Since a large percentage of the beverage will be immediately consumed, there is little time for the beverage to be warmed by the surrounding air and a relatively low ratio of cooling area to beverage volume is required. Later, with a partially full beverage container, the cooling ratio needs to be increased to keep the remaining beverage cool against the warming effect of the surrounding air. Prior art containers have not been designed to provide this variable cooling ratio.

Still another difficulty with prior art designs is the relatively low heat transfer rate between the beverage and ice. When ice is directly mixed with the beverage, the large surface area of the ice results in rapid heat transfer. However, in prior art designs, the wall between the ice compartment and the beverage compartment has significantly less surface area than ice immersed in the beverage, resulting in a low heat transfer rate. Consequently, the beverage may not be cooled sufficiently rapidly to counteract heat transferred into the beverage from the surroundings.

A final difficulty with prior art designs is that the ice and beverage compartments have usually been formed as separate components. This requires additional assembly and fastening or sealing operations during manufacture that greatly increase the cost of such containers and make them uncompetitive with simpler containers lacking the ice compartment.

In view of these deficiencies in the prior art, one object of the present invention is to provide an inexpensive beverage container with an ice compartment which can be easily handled when inverted and quickly filled by scooping in the crushed or cubed ice commonly found in most beverage serving commercial establishments.

Yet another object is to provide a beverage container with an ice compartment which can be sealed to inhibit melting of the ice. It is still another object of the present invention to provide an ice compartment which provides greater cooling relative to the remaining volume of beverage as the beverage is consumed.

A further object of the invention is to provide a beverage container with an improved heat transfer rate between the beverage and the ice.

SUMMARY OF THE INVENTION

The above and other objects, which will be apparent to those skilled in the art, are provided in the present invention which includes a beverage container with a beverage compartment having an upward opening for receiving beverages, and an ice compartment in heat exchange contact with the beverage compartment, the ice compartment being formed of an impact resistant material sufficient to resist repeated scooping impacts with crushed ice and having a sealable downward opening for receiving ice. A handle is attached to the container and has a comfortable shape and connection to the container when held in an upright position for filling the beverage compartment with a beverage and when held in an inverted position for scooping ice into the ice compartment. A cap is provided for watertight sealing of the downward opening of the ice compartment when the beverage container is upright.

In the preferred design, the handle is symmetrical (top to bottom) and is located below the upward opening of the beverage compartment and above the downward opening of the ice compartment. This provides a balanced configuration for handling the container in the upright position when full of beverage and in the inverted position for scooping ice.

The handle defines a gripping region with a width and depth that are sufficient to allow the handle to be gripped tightly with comfort during the scooping operation. The ends of the handle are connected to the beverage compartment at an angle thereto, preferably about ninety degrees. The angle of attachment is measured between the handle and the beverage compartment between the handle ends and is sufficiently large that the handle can be comfortably used in both the upright and inverted position. The large angle prevents a user's fingers from being compressed between the handle and the container particularly when scooping ice as the user's hand tends to slide longitudinally along the handle.

The cap seals the downward opening of the ice compartment so that the beverage container may be returned to the upright position and filled with the beverage. The seal is watertight so that meltwater from the ice does not escape.

In the most highly preferred design, the ice compartment is located inside the beverage compartment and shares a common conically shaped heat exchange wall with the beverage compartment. In this design the ratio of the area of the common wall contacted by the beverage held in the beverage compartment to the volume of beverage held by the beverage compartment increases as the volume of beverage held by the beverage compartment decreases. This provides greater heat transfer area relative to the beverage as the beverage is consumed.

The heat transfer characteristics are further improved by modifying the common wall through which the heat exchange occurs by providing ribs, corrugations or other means that increase the heat exchange area as compared to a smooth wall.

BRIEF DESCRIPTION OF THE DRAWINGS

FIG. 2 is a side elevational view of the embodiment in FIG. 1, partly in section.

FIG. 3 is a top plan view of the embodiment in FIG. 1.

FIG. 4 is a front elevational view of the embodiment in FIG. 1.

FIG. 5 is a bottom view of the embodiment in FIG. 1.

DESCRIPTION OF THE PREFERRED EMBODIMENT

Figure 1:
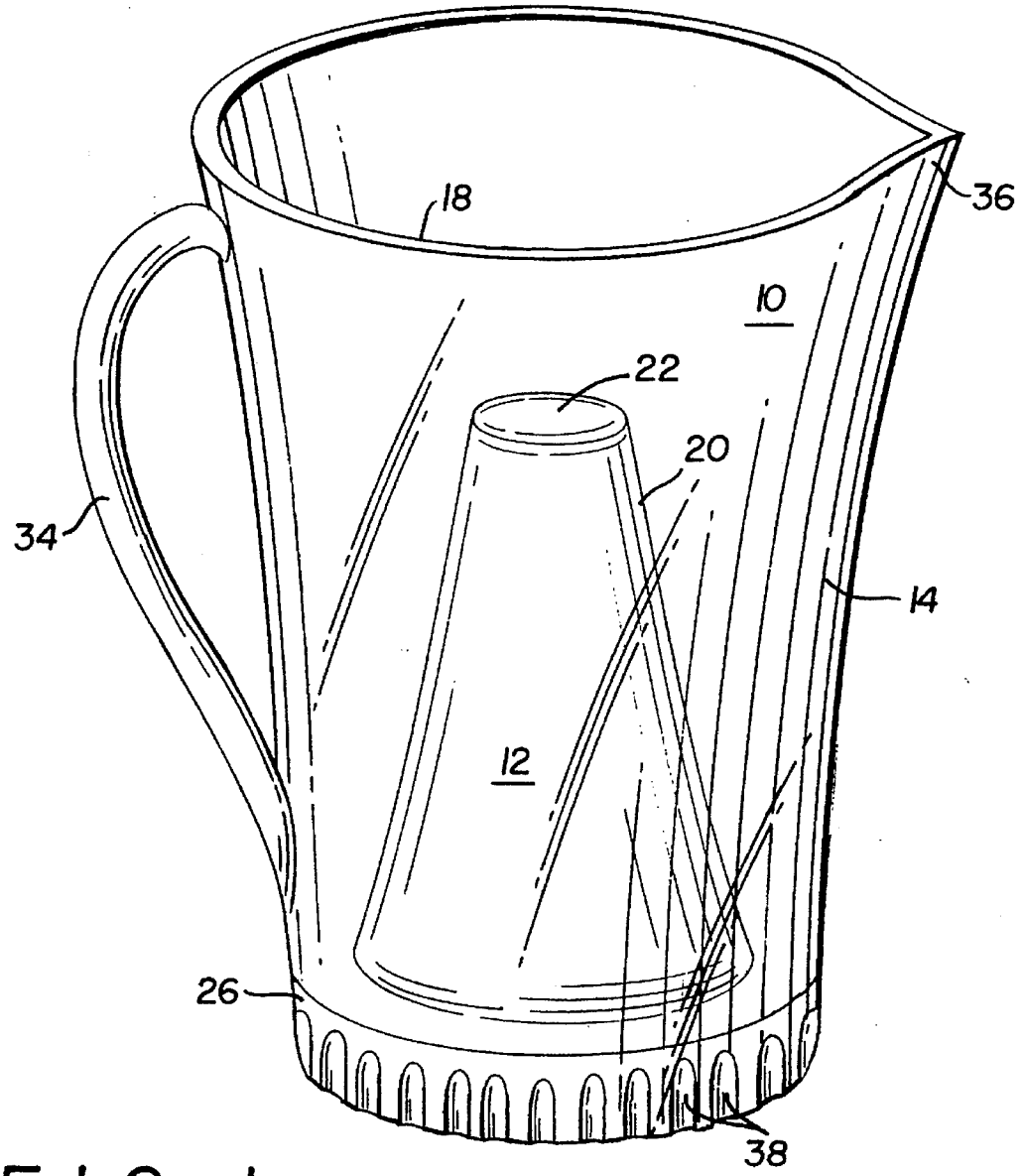
FIG. 1 is a perspective view of a first embodiment of the invention.
Figure 8:
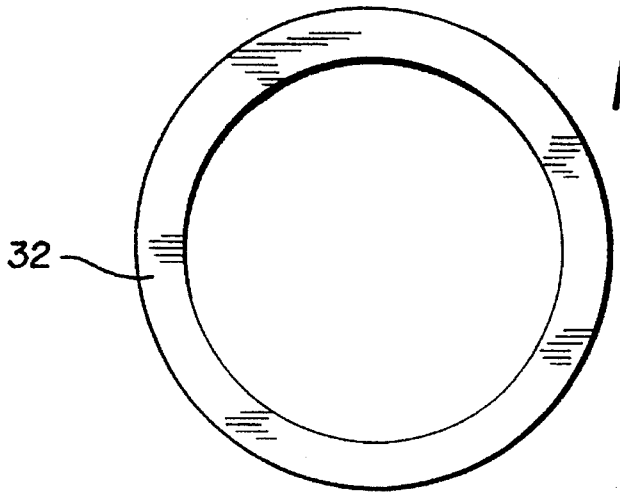
FIG. 8 is a plan view of an annular gasket providing a watertight seal between the cap and the pitcher for the embodiment in FIG. 1.
Figure 6:
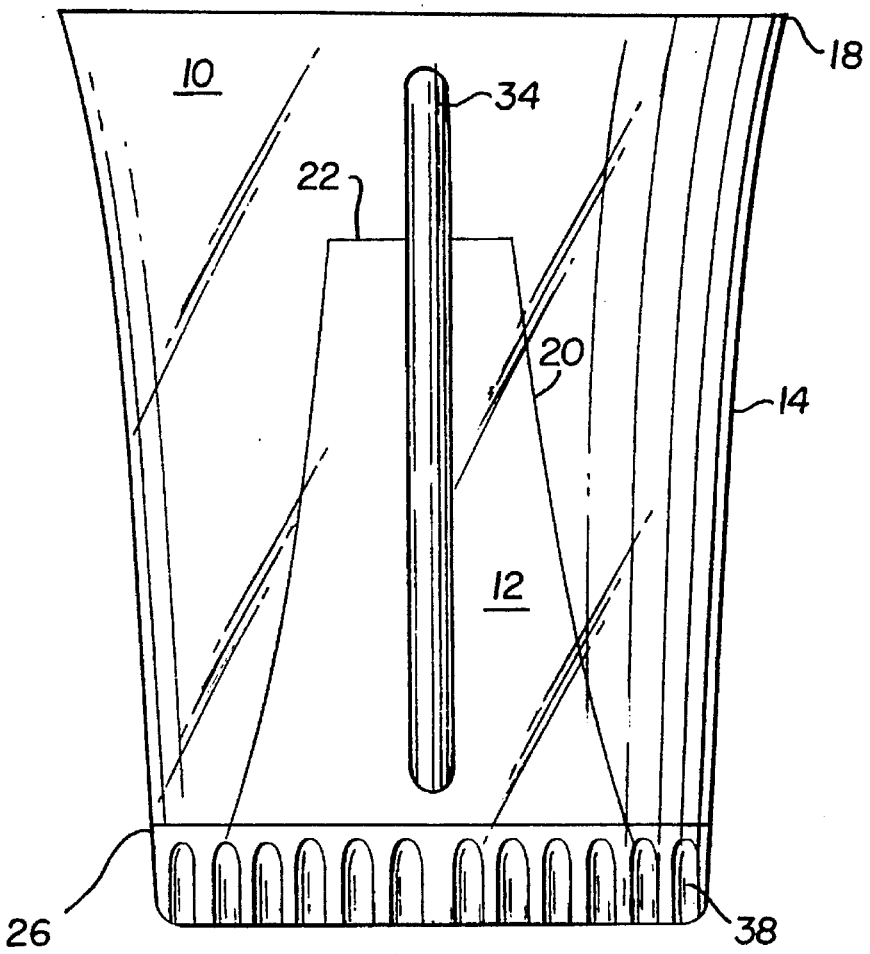
FIG. 6 is a rear elevational view of the embodiment in FIG. 1.
Figure 7:
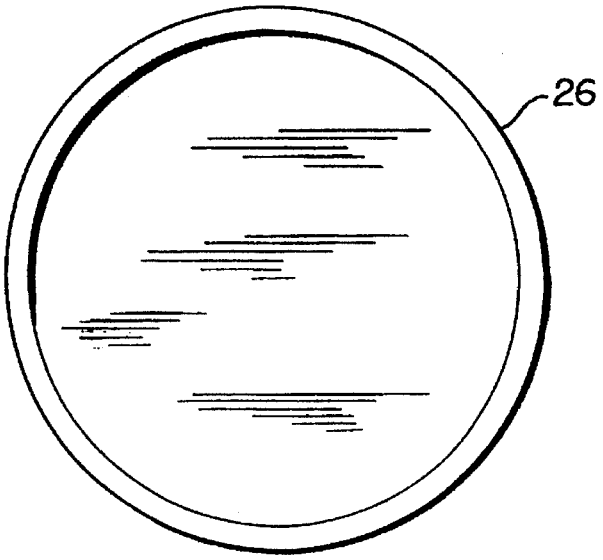
FIG. 7 is a top plan view of the bottom cap for the embodiment in FIG. 1.
Figure 9:
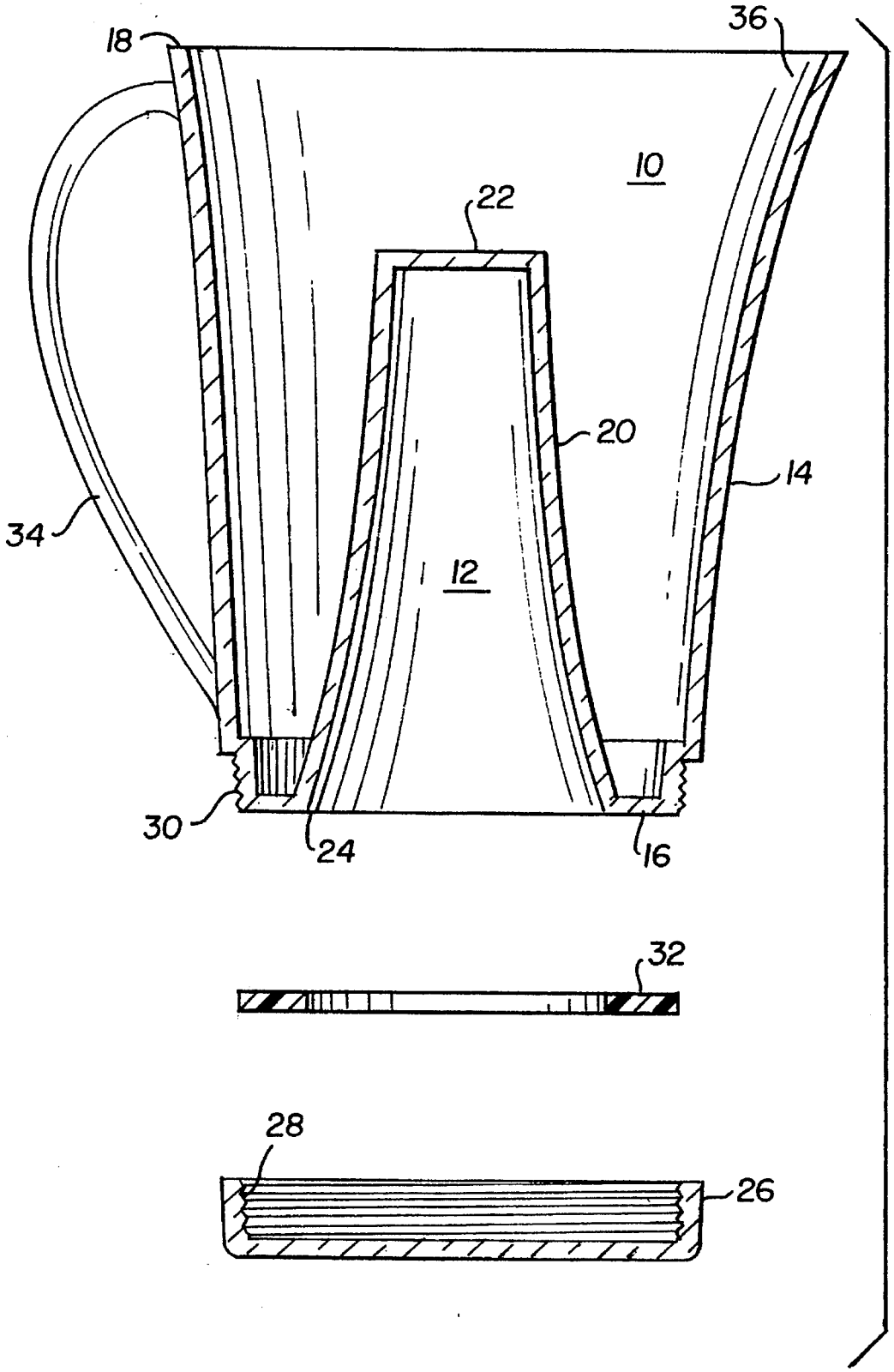
FIG. 9 is an exploded side elevation view of the embodiment in FIG. 1, in section.

Referring to FIGS. 1–9, the first embodiment of the invention includes a beverage compartment 10 which is upwardly open and downwardly closed and an ice compartment 12 which is downwardly open and upwardly closed. The beverage compartment is generally formed by an outer wall 14, an annular bottom wall 16 and an upward opening that is circumferentially defined by rim 18. An inner wall 20 is shared with the ice compartment 12 and provides heat exchange contact between ice in compartment 12 and a beverage to be cooled in compartment 10.

The ice compartment 12 is bounded by the inner wall 20, a top wall 22 and a downward opening which is circumferentially defined by a lip 24 located at the junction between the bottom wall 16 and the inner wall 20.

The downward opening of the ice chamber 12 is sealed with a cap 26 which has internal threads 28. The cap threads onto external threads 30 on the beverage container. A gasket 32 in the shape of an annular ring provides a watertight seal for the downward opening of the ice compartment 12. The beverage compartment is provided with a handle 34 which may conveniently be held in both the upright and in the inverted position, and a spout 36 for pouring the beverage.

When used, the beverage container is initially inverted and grasped by handle 34. The ice chamber 12 is then quickly and efficiently filled either by scooping the downward opening of the ice chamber into crushed ice, or by holding the ice chamber beneath an ice dispenser. The cap 26 is then screwed onto external threads 30, and the container is returned to the upright position for filling.

The gasket 32 is sized for a close fit within the interior of the cap 26 which prevents the gasket from falling out. The gasket is preferably formed of nylon, although other compressible or elastomeric materials may be used to provide the watertight seal. Cap 26 compresses the gasket forming the seal between the interior of the cap 26 and the bottom wall 16. The indentations 38 on the cap 26, seen best in FIG. 1, provide a means for gripping the cap and allow the cap to be tightened sufficiently to form a watertight seal.

By completely enclosing the ice within a sealed chamber 12, the beverage container design ensures that the ice cools the beverage and not the surrounding air, while simultaneously providing the watertight seal.

In the preferred arrangement of the two compartments, the entire upper surface of the beverage container consists of the upward opening of the beverage compartment. In this arrangement, the pitcher may be filled in the conventional manner by simply placing it under a beverage dispenser spout. There is no chance that beverage will enter the downward opening of the ice compartment, and no necessity to carefully align the filling spout relative to the ice compartment.

The top wall 22 of the ice compartment is placed below the level of the rim 18 to prevent splashing of the beverage out of the container during filling. The location of the top wall 22 relative to rim 18 also contributes to the variable cooling ratio feature of the container as described below.

Just as the entire upper surface of the beverage container consists of the upward opening of the beverage compartment, the entire lower surface of the container consists of the downward opening of the ice compartment 12. Accordingly, the ice compartment can also be filled easily without inadvertently getting ice into the beverage compartment.

Although a gasket 32 has been shown to provide the seal between the inside of the cap and the bottom wall 16, other methods of providing the watertight seal will occur to those skilled in the art. The seal may be made by an O-ring, by a sealing surface on the inside of the cap or simply by tightening the cap with suitable sealing surfaces between the cap and the beverage compartment. The bottom outer surface of the cap 26 serves as a base upon which the beverage container rests when in use.

A further important feature of the invention is the variable cooling ratio, referred to above, which is provided by the differential shape between the ice compartment 12 and the beverage compartment 10. In most applications, particularly in commercial use, the beverage is pre-chilled before it is dispensed into the beverage compartment 10. Thus, the beverage initially requires less cooling per unit of beverage volume. After the beverage is partially consumed, however, and while it is being exposed to warm surroundings for an extended period of time, greater contact cooling per unit of beverage volume is required.

The cooling ratio referred to is the ratio of 1) the area of the common heat exchange wall contacted by the beverage in the beverage compartment to 2) the volume of the beverage held by the beverage compartment. In the disclosed design this ratio increases as the volume of beverage held by the beverage compartment decreases. In the preferred design, this differential shaping is provided by using a truncated cone shape for the ice compartment 12.

The increase in the defined cooling ratio (as the liquid level decreases) is achieved in two ways. First, the top wall 22 is placed below the level of the rim 18. When the container is full, the beverage level is above the top wall 22, and the total area of the common heat exchange contact wall is the entire surface area of common walls 20 and 22. As the level of the liquid falls, but before it falls below the level of top wall 22, this common wall area does not decrease as the volume falls—which raises the cooling ratio.

Second, as the liquid level falls to below the level of the top wall 22, the cone shape of the inner ice compartment, and the slight inverted cone shape of the surrounding beverage compartment cause the volume held to decrease faster than the common wall contacted, causing the cooling ratio to continue to rise. The last quarter inch of remaining beverage will contact a much wider circumference of the ice compartment near the wide base of the ice compartment, than does a comparable quarter inch of beverage located just below top wall 22 near the narrow end of the cone.

The beverage container has been illustrated in the preferred embodiment with an internal ice compartment that is completely surrounded by the beverage compartment. However, side by side designs, or designs in which the beverage compartment is internal to the ice compartment are also contemplated and fall within the scope of the present invention.

The beverage container has been arranged with a design that is suitable for one piece injection molding process for inexpensive manufacturing in commercial quantities. All types of plastic adapted for injection molding and which are approved for use in food handling applications are suitable materials for constructing the beverage container.

FIGS. 10 through 17 show a second improved embodiment of the invention in which the same reference numerals have been used to indicate corresponding elements to the elements described in connection with the first embodiment. The designs in FIGS. 1 and 10 share certain important characteristics which differentiate them from the prior art and particularly adapt them for use in both the inverted and upright positions.

In both designs the handle 34 is positioned in a balanced location for easy upright/inverted use. The balance is achieved by locating the handle completely below the upward opening of the beverage compartment (defined by rim 18) and completely above the downward opening of the ice compartment.

Also in each, the portion of the handle that is gripped, i.e., the gripping region 44, extends both above and below a horizontal dividing plane of the container. The dividing plane is located at the midpoint between the upward opening of the beverage container and the downward opening of the ice compartment, approximately at the plane of the cross section 17—17 in FIG. 16. This places the gripping region of the handle near the center point of the container to provide the desired balance.

Without this balanced location for the handle, it is difficult to comfortably use the handle in both the inverted and upright positions to scoop ice and carry the container. Prior art designs often position the handle well above the midpoint dividing plane, often extending above the plane defined by the upward opening of the container. This location above the container makes it easy to carry the container while it is full of beverage, but very difficult to use the handle in the inverted position to scoop ice. On the other hand, if the handle is located too low on the container, below the mid-plane, handling the container while inverted is easy but carrying it full of beverage from this bottom position is quite difficult.

Figure 10:
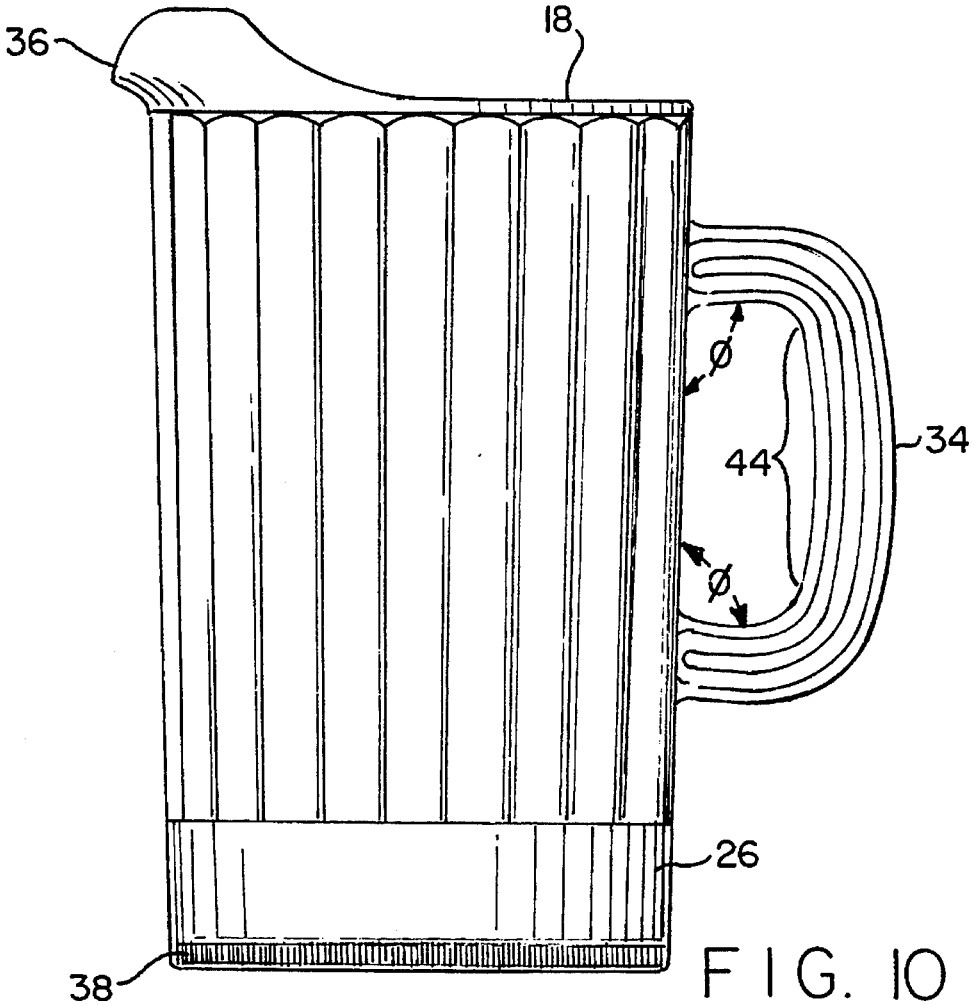
FIG. 10 is a left side elevational view of a second embodiment of the invention.
Figure 11:
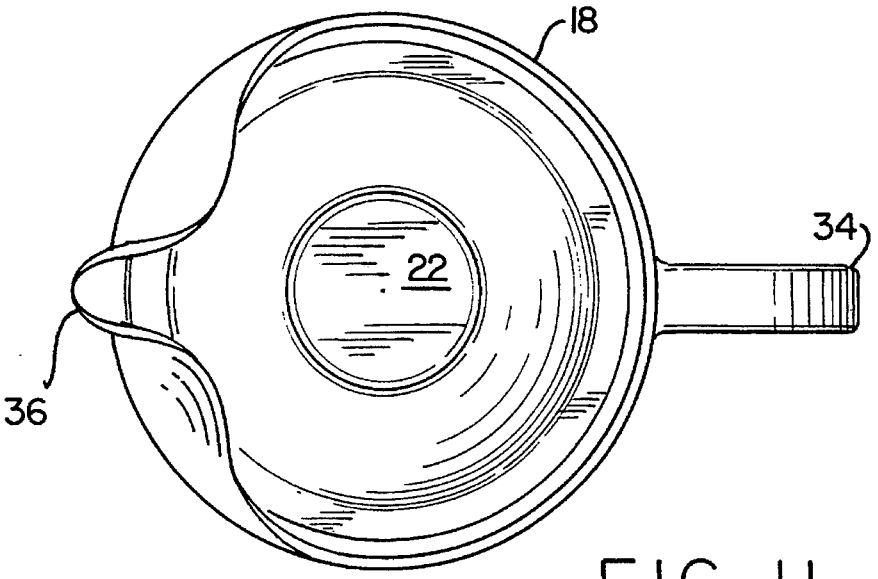
FIG. 11 is a top plan view of the embodiment in FIG. 10.
Figure 12:
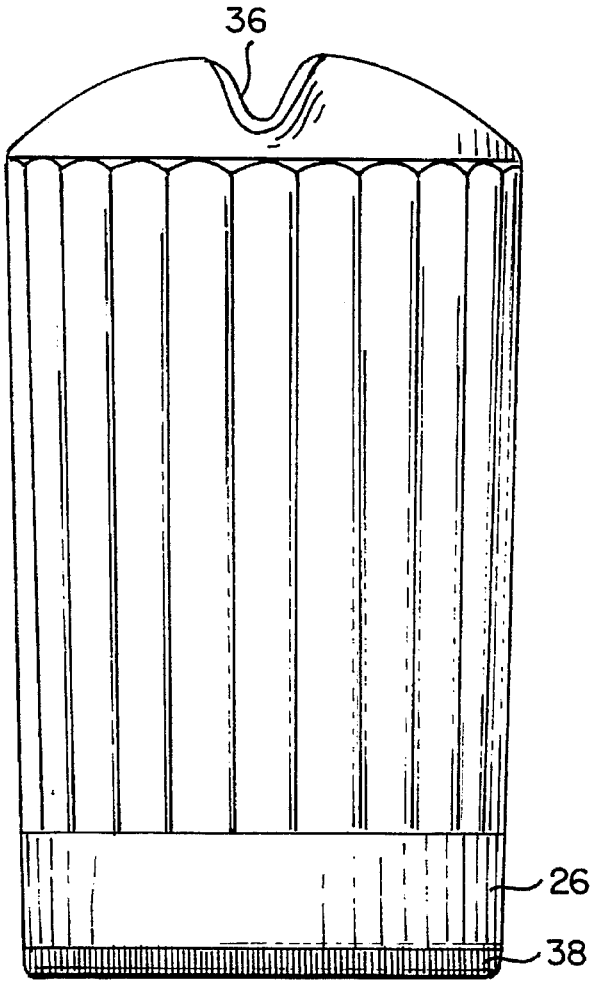
FIG. 12 is a front elevational view of the embodiment in FIG. 10.

Also in both designs, the handle is attached at a sufficiently large angle to the beverage compartment wall to prevent the user's fingers from sliding into the gap between the handle and the container wall and being uncomfortably compressed. The attachment angles $\theta$ and $\phi$ are shown in FIG. 10. In the design shown in FIG. 1, attachment angle $\phi$ is approximately 30 degrees which is just sufficient to prevent the aforementioned problem. Whereas in the design shown in FIG. 10, that angle of attachment has been steepened to about 90 degrees to improve comfort. Moreover, the handle in FIG. 10 has been made symmetrical top to bottom, with attachment angles θ and ϕ being approximately the same, which promotes the symmetrical use in the upright and inverted positions.

Another feature that is common to both designs is that the handle is provided with sufficient width and depth within the gripping region that the handle may comfortably be gripped very tightly. A tight grip and a relatively high level of force may occasionally be needed to penetrate a hard mound of crushed ice. The level of force required, and the impact the container suffers from such use are well beyond the levels found in the conventional use of a similar container without an ice compartment, or in containers with ice compartments that are not adapted for inverted/upright use. Thus the impact resistance, handle placement and handle comfort features are important to a successful implementation of this invention.

Figure 15:
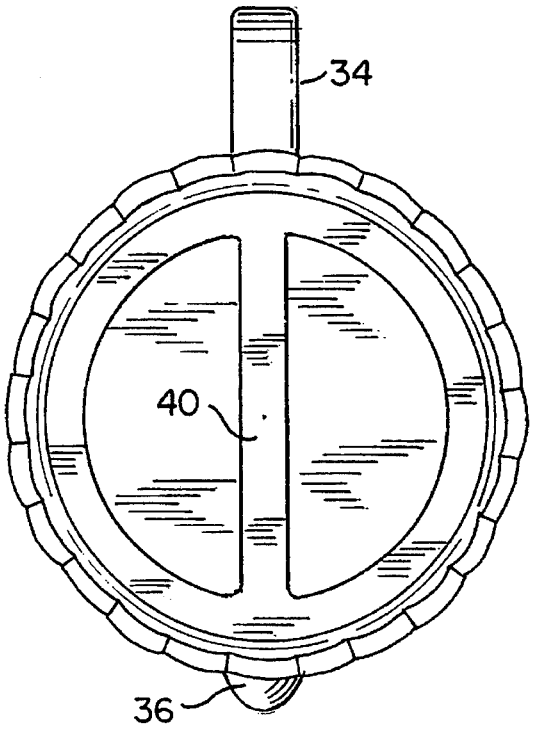
FIG. 15 is a bottom plan view of the embodiment in FIG. 10.
Figure 13:
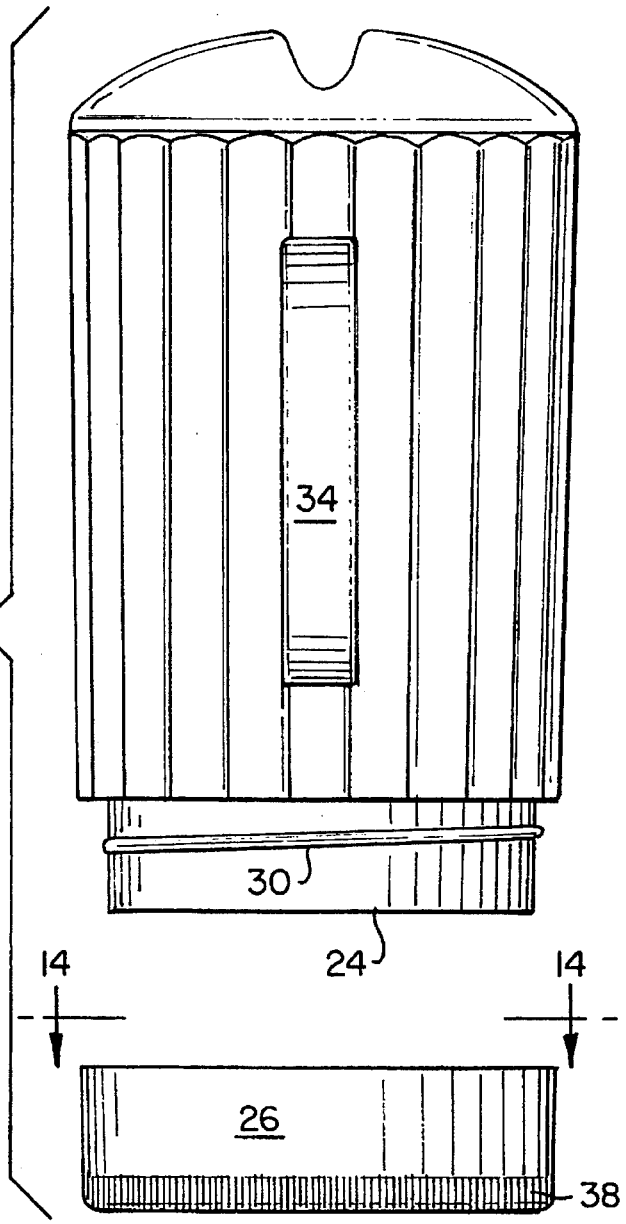
FIG. 13 is an exploded rear elevational view of the embodiment in FIG. 10 showing the cap removed.
Figure 14:
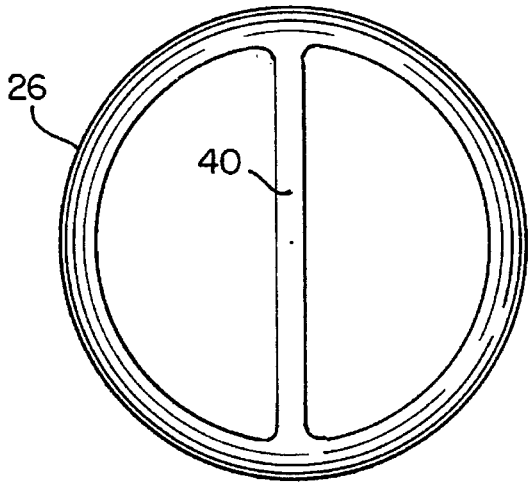
FIG. 14 is a top plan view of the cap taken along the lines of 14—14 in FIG. 13.

In addition to the handle symmetry, a further modification to the container of FIG. 1 can be seen in FIG. 15. While both designs have indentations 38 on the exterior of the cap 26 to make removal and attachment easier, the design in FIGS. 10–17 has a turning bar 40 molded into the bottom of the cap 26. The bar can be gripped to provide greater force as needed to tighten or loosen the cap 26. The turning bar is recessed into the cap which permits it to rest flat upon a countertop and act as a base for the container 10.

Figure 16:
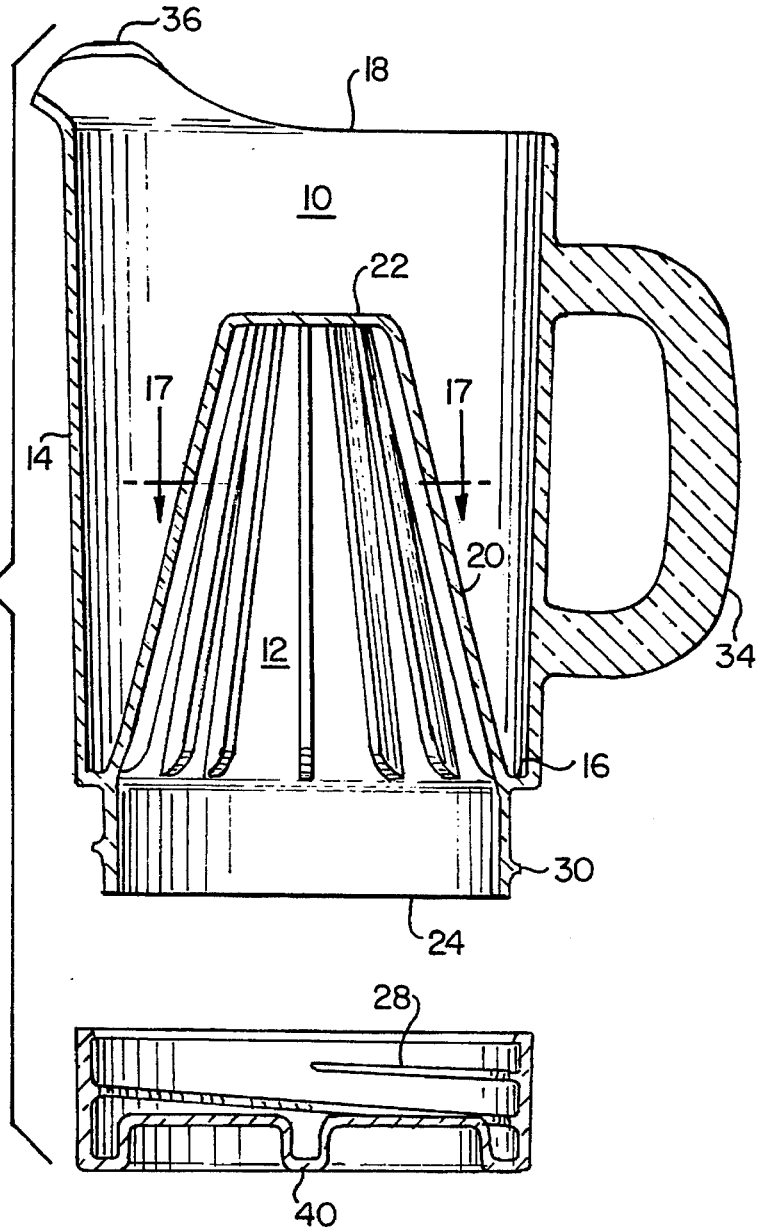
FIG. 16 is a left side elevational view of the embodiment in FIG. 10 taken in section, illustrating the ice compartment and showing the cap removed.
Figure 17:
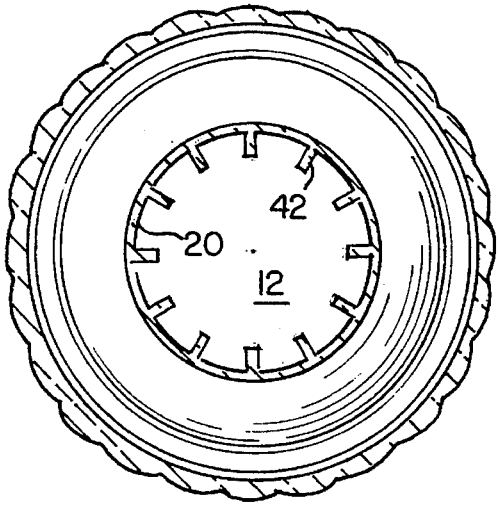
FIG. 17 is a cross-sectional view along the line 17—17 in FIG. 16.

Another improved feature of the second embodiment can be seen in FIGS. 16 and 17 in which a means for increasing the heat transfer surface area through the common inner wall 20 is shown. The means for increasing the heat transfer surface area shown in FIGS. 16 and 17 comprises a plurality of heat transfer ribs 42 extending into the ice compartment 12. Those skilled in the art, however, will recognize that a variety of other means may be used for increasing the heat transfer surface area and the heat transfer rate. For example, corrugations may be applied to the wall 20 by shaping it in a serpentine or zig-zag configuration. This lengthens the wall and increases the surface area through which heat may be transferred. Alternatively, protrusions similar to the ribs, or in the shape of tabs, protruding bubbles, etc. may be added into the ice compartment and/or the beverage compartment. All of these methods will accomplish the desired result of increasing the heat transfer surface area beyond that provided by a smooth common wall.

While this invention has been described with reference to specific embodiments, it will be recognized by those skilled in the art that variations are possible without departing from the spirit and scope of the invention, and that it is intended to cover all changes and modification of the invention disclosed herein for purposes of illustration which do not constitute departure from the spirit and scope of the invention.

Having thus described the invention, what is claimed is:

1. A beverage container comprising:

an upwardly open and downwardly closed beverage compartment having an upward opening for receiving beverages that extends across substantially the entire width of the beverage compartment, the beverage compartment being downwardly closed across the entire width of the upward opening of the beverage compartment;

an upwardly closed and downwardly open frusto-conical ice compartment positioned inwardly with respect to the beverage compartment in permanent heat exchange contact with the beverage compartment, the ice compartment being integrally molded as one piece with the beverage compartment of an impact resistant material sufficient to resist repeated scooping impacts with crushed ice and having a sealable downward opening for receiving ice into the ice compartment, the downward opening extending across substantially the entire width of the ice compartment and including a lip suitable for scooping into crushed ice;

a handle attached to the beverage container adapted for use in an upright and in an inverted position and cooperating with the ice compartment and the downward opening thereof to form an ice scoop for scooping ice into the ice compartment, the handle having a comfortable shape when held tightly and a comfortable angle of connection to the container at a top and bottom end of the handle such that a user's fingers are not compressed between the handle and the container when the container is held in an upright position for filling the beverage compartment with a beverage and when held in an inverted position for scooping ice into the ice compartment; and a cap for sealing the downward opening of the ice compartment when the beverage compartment is upright to retain ice scooped into the ice compartment, the cap including internal threads for engaging external threads on the beverage container to seal the cap across the downward opening of the ice compartment.

2. A beverage container according to claim 1 wherein the handle has a top end and a bottom end, the ends being attached to the beverage compartment at an angle thereto, the angle of attachment of the handle at each end, measured between the handle and the beverage compartment between the handle ends, being sufficiently large to permit the handle to be comfortably used in both the upright and inverted position without compressing a user's fingers between the handle and the container.

3. A beverage container according to claim 2 wherein the angle of attachment of the handle is at least thirty degrees.

4. A beverage container according to claim 2 wherein the angle of attachment of the handle is approximately ninety degrees.

5. A beverage container according to claim 1 wherein the handle includes a gripping region, the gripping region being located below the upward opening of the beverage compartment and above the downward opening of the ice compartment to provide a balanced configuration for handling the container in the upright position when full of beverage and in the inverted position for scooping ice.

6. A beverage container according to claim 1 wherein the handle includes a gripping region, the gripping region having a sufficiently large width and depth to permit the handle to be gripped tightly with comfort when scooping ice into the ice compartment.

7. A beverage container according to claim 1 wherein the handle includes a gripping region, the gripping region extending above and below a horizontal dividing plane of the container located at the midpoint between the upward opening of the beverage compartment and the downward opening of the ice compartment to provide a balanced configuration for handling the container in the upright position when full of beverage and in the inverted position for scooping ice.

8. A beverage container according to claim 1 wherein the handle is substantially symmetrical top to bottom.

9. A beverage container according to claim 1 further comprising a sealing means for sealing between the cap and the downward opening of the ice compartment.

10. A beverage container according to claim 9 wherein the sealing means comprises an annular ring between the cap and the downward opening of the ice compartment.

11. A beverage container according to claim 1 wherein the beverage compartment comprises an outer wall, an inner wall surrounded by the outer wall and an annular base between the inner and outer wall and wherein the inner wall of the beverage compartment is shared with the ice compartment, the shared inner wall providing the heat exchange contact between the beverage compartment and the ice compartment.

12. A beverage container according to claim 11 wherein the ice compartment is closed at its upper end by a top wall, the diameter of the ice compartment at the top wall being less than the diameter of the ice compartment at the downward opening.

13. A beverage container according to claim 11 wherein the beverage compartment is externally threaded at a lower edge of the outer wall defining the downward opening of the ice compartment and the cap is internally threaded to sealingly engage the threaded beverage compartment and seal the downward opening of the ice compartment, the lower edge of the outer wall having sufficient strength to resist damage when scooping ice.

14. A beverage container according to claim 1 wherein the ice compartment shares a common wall with the beverage compartment for the heat exchange contact, and the ice compartment and beverage compartment are differentially shaped such that the ratio of the area of the common wall contacted by beverage held in the beverage compartment to the volume of beverage held by the beverage compartment increases as the volume of beverage held by the beverage compartment decreases.

15. A beverage container according to claim 1 wherein the beverage compartment and ice compartment are formed by injection molding.

16. A beverage container according to claim 1 wherein the cap acts as a base to hold the beverage container when set upon a horizontal surface.

17. A beverage container according to claim 15 wherein the cap includes a gripping surface on its exterior.

18. A beverage container according to claim 1 wherein the cap includes a recessed turning bar.

19. A beverage container according to claim 1 wherein the ice compartment shares a common wall with the beverage compartment for the heat exchange contact, the common wall including means for increasing the heat transfer surface area thereof.

20. A beverage container according to claim 19 wherein the means for increasing the heat transfer surface area of the common wall comprises a plurality of ribs extending from the common wall.

21. A beverage container according to claim 20 wherein the ribs extend into the ice compartment.

22. A beverage container according to claim 19 wherein the means for increasing the heat transfer surface area of the common wall comprises corrugations formed in the common wall.

23. A beverage container comprising:

a beverage compartment and an ice compartment formed as a single piece of an impact resistant plastic material, the beverage compartment being upwardly open for receiving beverages at an upper edge of an outer wall enclosing the beverage compartment, the upward opening extending across substantially the entire width of the beverage compartment, the beverage compartment being downwardly closed by an annular bottom wall, an inner wall and a top wall, the outer wall having a lower edge, the bottom wall having an inner and outer perimeter, the outer perimeter contacting the lower edge of the outer wall and the inner perimeter contacting the inner wall, the ice compartment being conically shaped and downwardly open and formed on the opposite of the inner wall and the opposite side of the top wall from the beverage compartment in heat exchange contact with the beverage compartment through the inner and top walls, the ice compartment having sufficient thickness and strength of the impact resistant material along the downward opening to resist repeated scooping impacts with crushed ice without damage, the ice compartment being externally threaded around the downward opening, the diameter of the ice compartment at the top wall being less than the diameter of the ice compartment at the downward opening;

a plurality of heat exchange ribs attached to the inner wall for increasing the rate of heat transfer between the beverage compartment and the ice compartment;

a handle attached to the container cooperating with the ice compartment and the downward opening to act as an ice scoop for filling the ice compartment, the handle having a comfortable shape and connection to the container when held in an upright position for filling the beverage compartment with a beverage and when held in an inverted position for scooping ice into the ice compartment, the handle having a top end and a bottom end, the ends being attached to the beverage compartment at an angle thereto, the angle of attachment of the handle at each end, measured between the handle and the beverage compartment between the handle ends, being sufficiently large to permit the handle to be comfortably used in both the upright and inverted position without compressing a user's fingers between the handle and the container, the handle having a gripping region, the gripping region being located below the upward opening of the beverage compartment and above the downward opening of the ice compartment to provide a balanced configuration for handling the container in the upright position when full of beverage and in the inverted position for scooping ice, the gripping region having a sufficiently large width and depth to permit the handle to be gripped tightly with comfort when scooping ice into the ice compartment, the gripping region extending above and below a horizontal dividing plane of the container located at the midpoint between the upward opening of the beverage compartment and the downward opening of the ice compartment to provide a balanced configuration for handling the container in the upright position when full of beverage and in the inverted position for scooping ice; and an internally threaded cap for engaging the externally threaded downward opening of the ice compartment and watertight sealing the downward opening of the ice compartment when the beverage compartment is upright, the cap sealing the ice compartment without extending into the ice compartment to allow the ice compartment to be filled to the downward opening by scooping and subsequently sealed by the cap.

* * * * *